US011460815B2

(12) United States Patent
Frey et al.

(10) Patent No.: US 11,460,815 B2
(45) Date of Patent: Oct. 4, 2022

(54) WRISTWATCH WITH BATTERY INTEGRATED IN THE CLASP

(71) Applicant: Renata AG, Itingen (CH)

(72) Inventors: Remo Frey, Titterten (CH); Pascal Haering, Muttenz (CH)

(73) Assignee: Renata AG, Itingen (CH)

( * ) Notice: Subject to any disclaimer, the term of this patent is extended or adjusted under 35 U.S.C. 154(b) by 345 days.

(21) Appl. No.: 16/779,777

(22) Filed: Feb. 3, 2020

(65) Prior Publication Data

US 2020/0301372 A1 Sep. 24, 2020

(30) Foreign Application Priority Data

Mar. 20, 2019 (EP) ..... 19164081

(51) Int. Cl.

| | |
|---|---|
| ***G04G 17/06*** | (2006.01) |
| ***A44C 5/24*** | (2006.01) |
| ***G04C 10/00*** | (2006.01) |
| ***G04G 19/00*** | (2006.01) |

(52) U.S. Cl.

CPC ..... *G04G 17/06* (2013.01); *A44C 5/24* (2013.01); *G04C 10/00* (2013.01); *G04G 19/00* (2013.01)

(58) Field of Classification Search

CPC ..... G04G 17/06; G04G 19/00; G04G 17/02; G04G 17/083; G04G 9/0017; G04G 9/04; A44C 5/24; G04C 10/00; G04B 37/14

See application file for complete search history.

(56) References Cited

U.S. PATENT DOCUMENTS

| | | |
|---|---|---|
| 4,378,957 A | 4/1983 | Malkin et al. |
| 4,539,736 A | 9/1985 | Yokosuka |

(Continued)

FOREIGN PATENT DOCUMENTS

| | | |
|---|---|---|
| CA | 2 164 392 C | 5/2005 |
| CA | 2 711 341 A1 | 12/2008 |

(Continued)

OTHER PUBLICATIONS

Combined Chinese Office Action and Search Report dated Mar. 11, 2021 in Patent Application No. 202010185784.5 (with English language translation and English translation of Category of Cited Documents), 17 pages.

(Continued)

*Primary Examiner* — Edwin A. Leon

(74) *Attorney, Agent, or Firm* — Oblon, McClelland, Maier & Neustadt, L.L.P.

(57) ABSTRACT

A battery-operated wristwatch includes a watch case, two strap parts and a clasp, wherein a battery housing including a battery is integrated in the clasp. One of the strap parts includes power transmission wires. The battery housing is coupled to the power transmission strap part by a first coupling that allows the transmission of a power signal. Likewise, the power transmission strap part is coupled to the watch case by a second coupling that allows the transmission of the power signal from the battery to the watch case. Particular embodiments are related to a watch provided with a deployable clasp comprising clasp portions which can be folded together, and wherein the battery housing is attached to one of the clasp portions.

14 Claims, 8 Drawing Sheets

(56) References Cited

U.S. PATENT DOCUMENTS

| | | | | |
|---|---|---|---|---|
| 8,976,628 | B2 * | 3/2015 | Leoni | G04G 21/00 368/10 |
| 9,274,506 | B2 * | 3/2016 | Lu | A44C 5/14 |
| 9,445,633 | B2 * | 9/2016 | Tulloch | A41D 1/005 |
| 10,058,148 | B1 | 8/2018 | Wittenberg et al. | |
| 2006/0140055 | A1 * | 6/2006 | Ehrsam | G06K 19/07762 368/10 |
| 2007/0064542 | A1 * | 3/2007 | Fukushima | G04G 21/00 368/282 |
| 2011/0172003 | A1 | 7/2011 | Yamamoto et al. | |
| 2011/0182151 | A1 * | 7/2011 | Geyer | G04G 17/083 368/68 |
| 2015/0085623 | A1 | 3/2015 | Modaragamage | |
| 2015/0378312 | A1 | 12/2015 | Modaragamage | |
| 2016/0324277 | A1 | 11/2016 | Modaragamage | |
| 2016/0334759 | A1 | 11/2016 | Modaragamage | |
| 2017/0006977 | A1 | 1/2017 | Modaragamage | |
| 2017/0009761 | A1 | 1/2017 | Matsunaga et al. | |
| 2017/0127773 | A1 | 5/2017 | Modaragamage | |
| 2018/0020786 | A1 | 1/2018 | Fernandes Demetrio et al. | |
| 2018/0090890 | A1 | 3/2018 | Kallman et al. | |
| 2019/0129363 | A1 | 5/2019 | Modaragamage | |

FOREIGN PATENT DOCUMENTS

| | | | |
|---|---|---|---|
| CH | 543 768 | A | 7/1973 |
| CN | 2211122 | Y | 10/1995 |
| CN | 2752826 | Y | 1/2006 |
| CN | 201899212 | U | 7/2011 |
| CN | 102846104 | A | 1/2013 |
| CN | 202751112 | U | 2/2013 |
| CN | 104243637 | A | 12/2014 |
| CN | 205122753 | U | 3/2016 |
| CN | 205334075 | U | 6/2016 |
| CN | 106325053 | A | 1/2017 |
| CN | 206227835 | U | 6/2017 |
| CN | 107111279 | A | 8/2017 |
| CN | 107157038 | A | 9/2017 |
| CN | 206760943 | U | 12/2017 |
| CN | 108514190 | A | 9/2018 |
| CN | 208156432 | U | 11/2018 |
| EP | 0 125 930 | A2 | 11/1984 |
| EP | 1 538 697 | B1 | 4/2014 |
| EP | 3 366 155 | A1 | 8/2018 |
| FR | 2040419 | | 1/1971 |
| GB | 2 193 043 | A | 1/1988 |
| JP | 11-215721 | A | 8/1999 |
| JP | 2002-51474 | A | 2/2002 |
| JP | 2003-229938 | A | 8/2003 |
| JP | 2018-5572 | A | 1/2018 |
| WO | WO 2007/077284 | A1 | 7/2007 |
| WO | WO 2015/200688 | A1 | 12/2015 |
| WO | WO 2016/038058 | A2 | 3/2016 |

OTHER PUBLICATIONS

Japanese Office Action dated Nov. 10, 2020 in Japanese Patent Application No. 2020-022230 (with English translation), 10 pages.

European Search Report dated Sep. 16, 2019 in European Application 19164081.2 filed Mar. 20, 2019 (with Written Opinion), 9 pages.

Combined Chinese Office Action and Search Report dated Sep. 28, 2021 in Chinese Patent Application No. 202010185784.5 (with English translation), 21 pages.

* cited by examiner

WRISTWATCH WITH BATTERY INTEGRATED IN THE CLASP

CROSS-REFERENCE TO RELATED APPLICATION

This application claims priority to European Patent Application No. 19164081.2 filed on Mar. 20, 2019, the entire disclosure of which is hereby incorporated herein by reference.

FIELD OF THE INVENTION

The present invention relates to battery-operated wristwatches, not exclusively but primarily to watches of the smartwatch type.

STATE OF THE ART

Smartwatches require higher capacity power sources than standard watches. Batteries are therefore bulkier and the integration of the battery into the watch itself becomes difficult. Presently known solutions to this problem include power sources integrated in the wrist strap and connected to the watch case by standard plug-in connectors, but this makes the strap stiff and uncomfortable to wear.

SUMMARY OF THE INVENTION

The invention aims to provide a wristwatch that overcomes the above-described problems. This aim is achieved by a wristwatch as described in the appended claims. A battery-operated wristwatch according to the invention comprises a watch case, two strap parts and a clasp, wherein a battery housing comprising a battery is integrated in the clasp. One of the strap parts, hereafter referred to as the power transmission strap part, comprises power transmission wires. The battery housing is coupled to the power transmission strap part by a first coupling that allows the transmission of a power signal. Likewise, the power transmission strap part is coupled to the watch case by a second coupling that allows the transmission of the power signal from the battery to the watch case.

The clasp may be any type of clasp known in the art, with the addition of the battery housing attached to a portion of the clasp. The attachment of the battery housing to the clasp portion may be an immovable attachment, i.e. the battery housing is fixedly attached to the clasp portion or integral with said portion, or the housing may be attached to the clasp portion while still allowing a relative movement of the housing relative to the clasp portion. In particular, the battery housing may be rotatably attached to the clasp portion.

Particular embodiments are related to a wristwatch comprising a deployable clasp, that includes a first and second clasp portion arranged to pivot relative to each other. According to the invention, the battery housing is attached to one of the two clasp portions, and the housing is furthermore rotatably coupled to the power transmission strap part, by a rotatable and power-transmitting coupling. A preferred embodiment of the deployable clasp in a watch according to the invention includes clasp portions in the form of frame elements, one of which is rotatably attached to the battery housing and wherein the frame elements are configured to become lodged around the battery housing when the clasp is in the closed condition.

A preferred embodiment of the rotatable coupling capable of transmitting a power signal includes rounded contacts arranged on a rod having a circular cross-section. The rod is itself laterally mounted on a throat section. The rotatable coupling further comprises a hollow cylindrical bracket provided with spring-operated contacts and a blocking lobe. The blocking lobe is configured to allow the axial insertion and removal of the rod and the throat section into the bracket at a defined angular position of the rod, while blocking the removal of the rod at other angular positions, thereby realising an easily detachable coupling.

The invention provides a solution to the above-cited problems of the prior art. The battery housing is located outside the watch case and outside the watch straps. According to preferred embodiments, the battery housing is easily exchangeable, thereby facilitating battery replacement and/or replacement of the strap parts. Specific embodiments furthermore allow improved solutions for charging the battery.

DETAILED DESCRIPTION OF PREFERRED EMBODIMENTS OF THE INVENTION

Figure 1A:
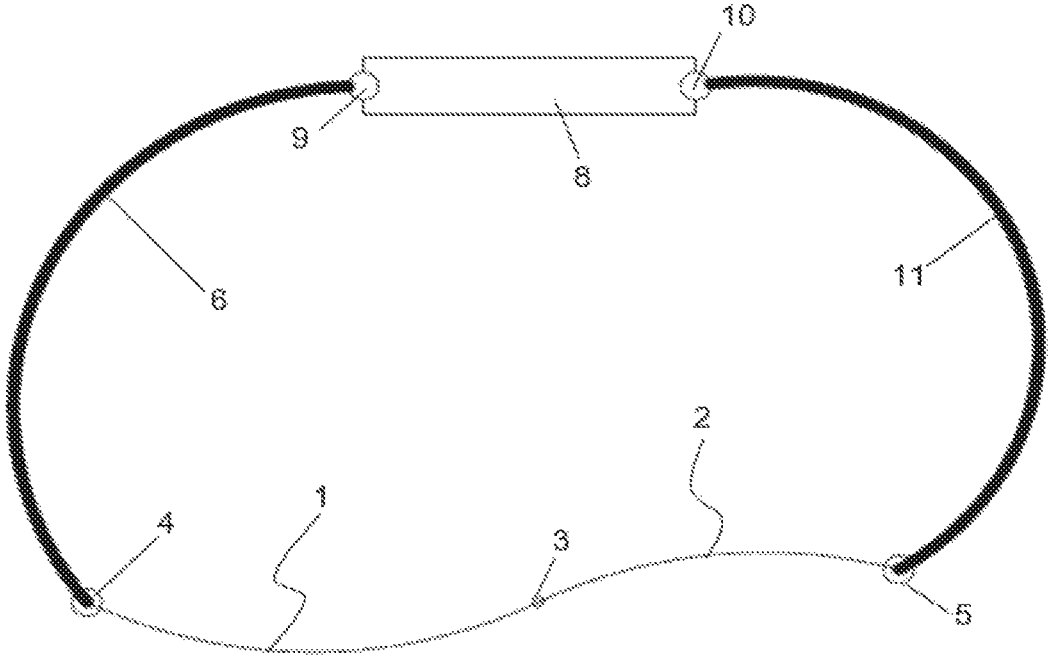
FIGS. 1*a* and 1*b* illustrate the concept of a deployable clasp for closing a wristwatch, as known in the art.
Figure 1B:
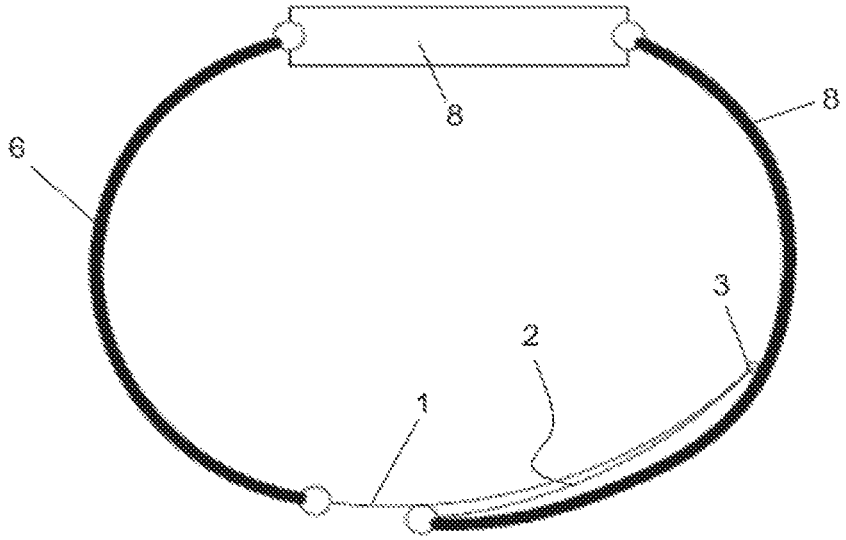

In order to define some of the terminology used in this description, the well-known principle of a wristwatch comprising a deployable clasp is illustrated in FIGS. 1*a* and 1*b*, showing a watch in the open and closed condition respectively. The clasp comprises two curved clasp portions 1 and 2 which are rotatably coupled to each other in a central pivot 3. The clasp portions 1 and 2 are furthermore coupled by rotatable couplings 4 and 5 to the respective ends of the two strap parts 6 and 11 of the wristwatch. The strap parts are coupled at their opposite ends to the watch case 8, by preferably rotatable couplings 9 and 10. As illustrated in FIG. 1*b*: to close the clasp, the two portions 1 and 2 are folded onto each other, and a securing mechanism is actuated for securing the clasp portions 1 an 2 to each other in the closed condition. This mechanism is not shown in the schematic drawing in FIG. 1, as it is well-known in the art. It may be a snap-action closure or the like. The curved clasp portions 1 and 2 may be curved plate elements, wherein one plate element becomes lodged on top of the other in the closed condition. Alternatively, the clasp portions may be curved beam or frame elements shaped so that one element fits into the other when they are folded together, so that the two elements are in the same curved plane when the clasp is closed.

Figure 2A:
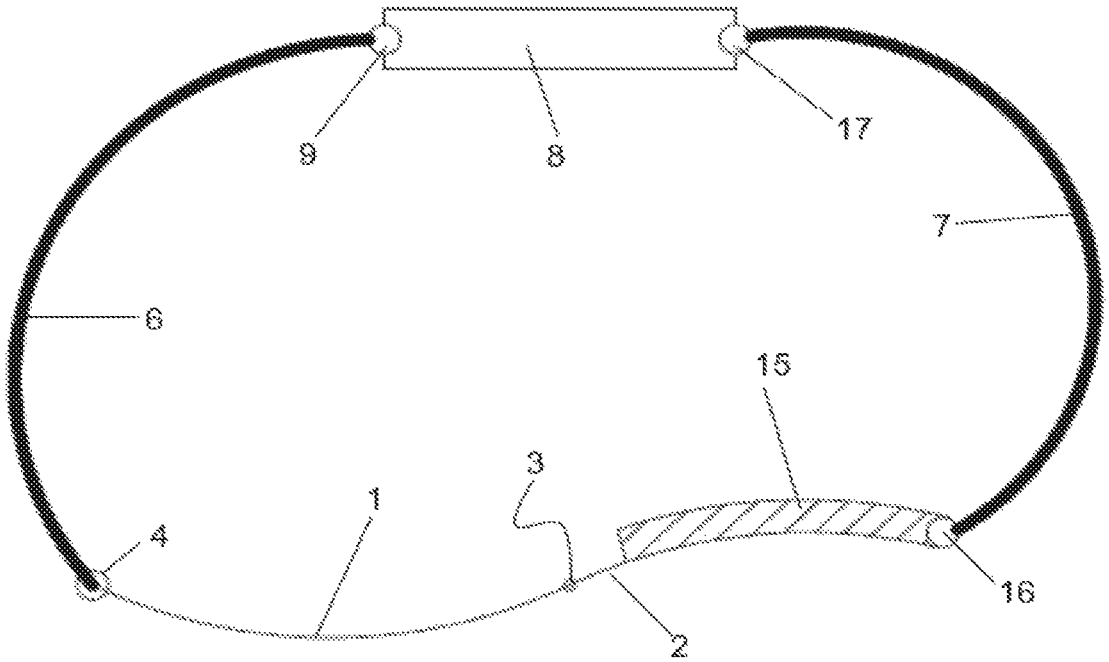
FIGS. 2*a* and 2*b* illustrate a wristwatch according to a first embodiment of the invention, wherein the battery housing is immovably attached to the surface of one of the deployable clasp portions.
Figure 2B:
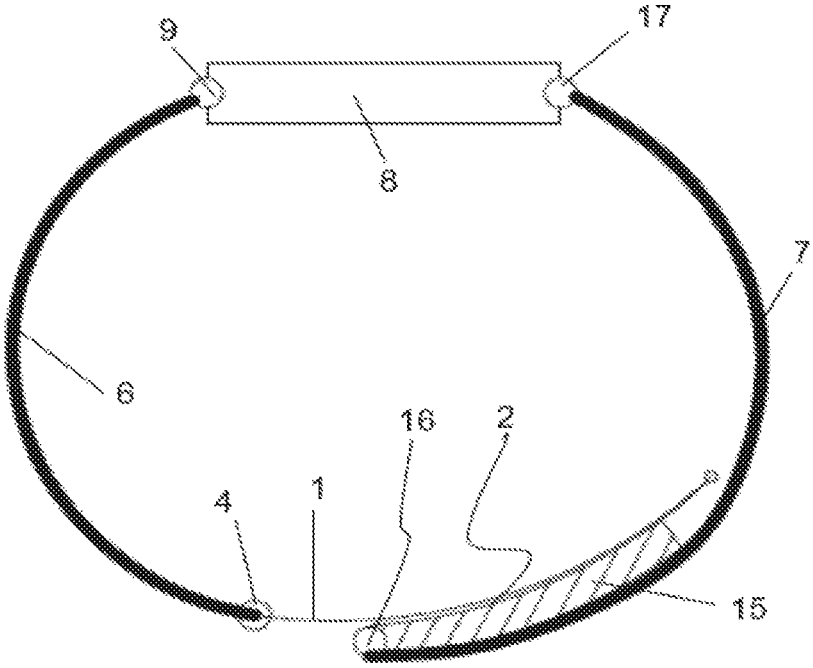

FIGS. 2*a* and 2*b* illustrate a battery-operated wristwatch according to an embodiment of the invention. Some of the components identified in FIGS. 1*a* and 1*b* are indicated by the same numerical references: the clasp portions 1 and 2, the central pivot 3, the first strap part 6, the watch case 8 and the (preferably) rotatable couplings 4 and 9. The clasp portions 1 and 2 are curved plate elements, and the battery housing 15 comprising the battery is attached to the surface of the second clasp portion 2, for example by welding or gluing the housing to the surface of the clasp portion 2. The housing 15 could also be integral with the clasp portion 2. In the illustrated embodiment, the housing 15 itself is shaped as a rectangular box (i.e. a prism having a rectangular basis) that is slightly curved and has the same curvature as the curved clasp portion 2 to which it is attached. In any embodiment of the invention, the housing 15 is formed of a material of adequate material properties for protecting the battery from mechanical loads and impacts. Various suitable metal or plastic materials may be used. In variants, the housing could take different shape for example the shape of a prism having a circular or elliptic basis.

The housing 15 is rotatably coupled to the second strap part 7, hereafter referred to as the power transmission strap part 7, by a rotatable coupling 16 that allows the transmission of an electrical power signal from the battery to the watch case 8, through electrical wires (not shown) integrated in the power transmission strap part 7. A preferred embodiment of the rotatable coupling 16 will be described further in this text. A second power transmitting coupling 17, preferably a rotatable coupling and preferably of the same type as the first coupling 16, is arranged between the power transmission strap part 7 and the watch case 8. FIGS. 2*a* and 2*b* are again conceptual drawings. The exact shape of the battery housing 15 and of the clasp portions 1 and 2 may be optimized in order to maximize the wearer's comfort. A securing mechanism for securing the closure of the clasp is not shown in this drawing but may be realised according to any system known in the art.

Figure 3A:
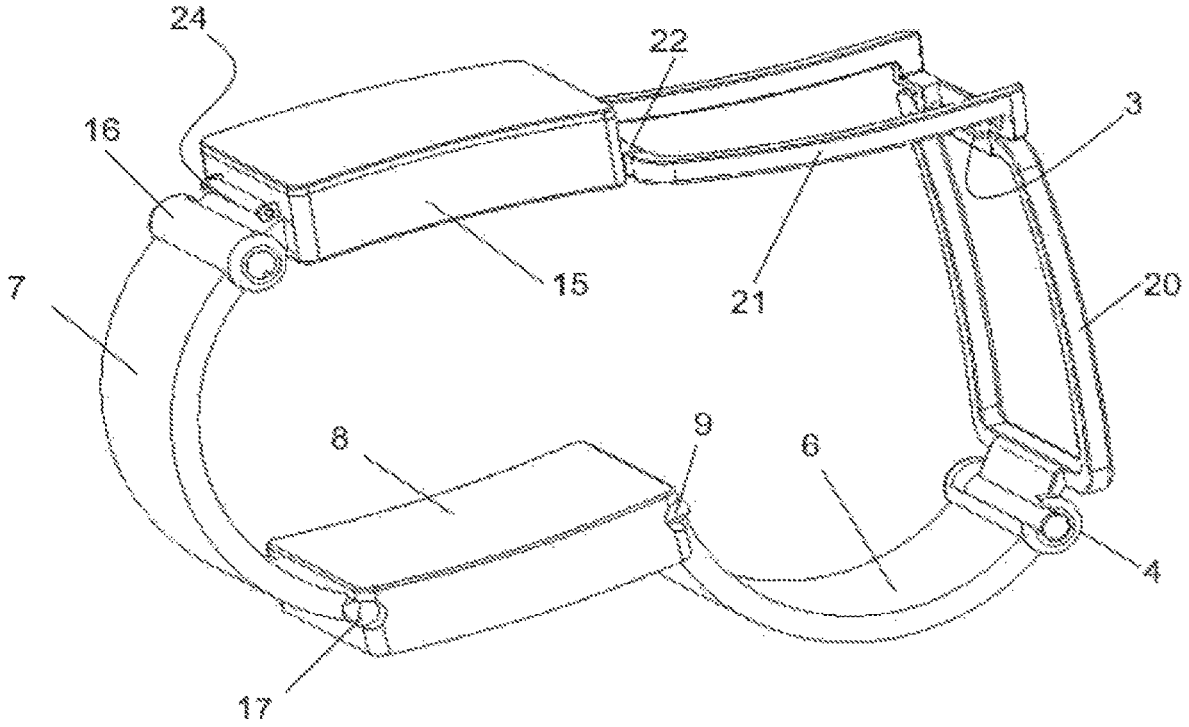
FIGS. 3*a* and 3*b* illustrate a wristwatch according to a second embodiment, wherein the battery housing is rotatably attached to a clasp portion and wherein the clasp portions are frame elements which are positioned around the battery housing when the clasp is in the closed condition.
Figure 3B:
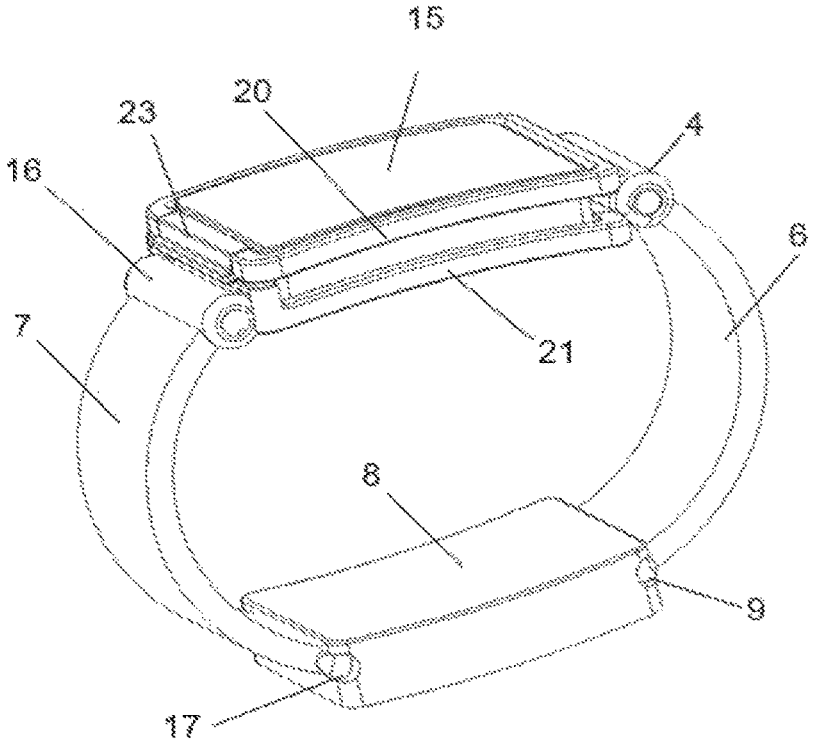

According to another embodiment illustrated in FIGS. 3*a* and 3*b*, the clasp portions are formed as rectangular frame elements 20 and 21 which are positioned around the battery housing 15 when the clasp is in the closed condition. FIG. 3*a* shows the watch in the open condition. The battery housing is again shaped as a rectangular and slightly curved box. A number of the above-described components are again recognizable: the watch case 8, the first strap part 6 and the power transmission strap part 7, the battery housing 15, the pivot 3, the standard (i.e. not power transmitting) couplings 4 and 9, the power transmitting couplings 16 and 17. The first clasp portion 20 is rotatably coupled to the first strap part 6, as in the previous embodiment. The second clasp portion 21 is rotatably attached to the battery housing 15 by a non-removable rotatable coupling 22. This could also be a removable coupling of any known type. The frame-shaped clasp portions 20 and 21 are preferably slightly curved by the same curvature as the battery housing 15, and dimensioned to fit around the circumference of the battery housing 15.

The functioning of the clasp shown in FIGS. 3*a* and 3*b* is described hereafter. The second clasp portion 21 is pivoted by the wearer about the axis of the coupling 22, said axis being positioned on the lower side of the housing's thickness so that when the second clasp portion 21 is folded over the housing 15, it surrounds said lower side in the closed condition of the clasp (see FIG. 3*b*). By folding the second clasp portion 21 in this way, the first clasp portion 20 becomes positioned around the upper side of the housing's thickness, i.e. the battery housing 15 becomes lodged inside each of the clasp portions 20 and 21 which surround the housing respectively at its lower and upper end as seen in the direction perpendicular to the curved surface of the housing. The second clasp portion 21 furthermore comprises a snap-action closure 23 configured to snap onto a pin 24 located on the side of the battery housing 15, opposite to the side where the coupling 22 is located. By snapping the closure 23 onto the pin 24, the clasp is secured. The advantage of this embodiment is that in the closed condition the thickness of the clasp is the same as the thickness of the housing, thereby enabling a thinner clasp design compared to the first embodiment described above.

In any of the above-described embodiments, the rotatable coupling 16 between the battery housing 15 and the power transmission strap part 7 must be configured to allow the transmission of a power signal from the battery inside the housing 15 to the watch case 8, via power transmission wires integrated in the power transmission strap part 7, and through a second power-transmitting coupling 17 between the strap part 7 and the watch case 8. Preferably the first and second power-transmitting couplings 16 and 17 are constructed in the same way. A rotatable and power-transmitting coupling suitable for this purpose may be brought into practice in various ways, and possibly according to designs known in the art. A previously unknown mechanism for realizing the couplings 16 and/or 17 is applied in the watch shown in FIGS. 3*a* and 3*b*, and described in more detail hereafter, with reference to FIGS. 4 and 5. The added advantage of this particular embodiment is that the coupling can be de-coupled by the wearer of the watch, enabling easily replacement of the strap parts 6 and 7 and/or of the battery housing 15.

Figure 4A:
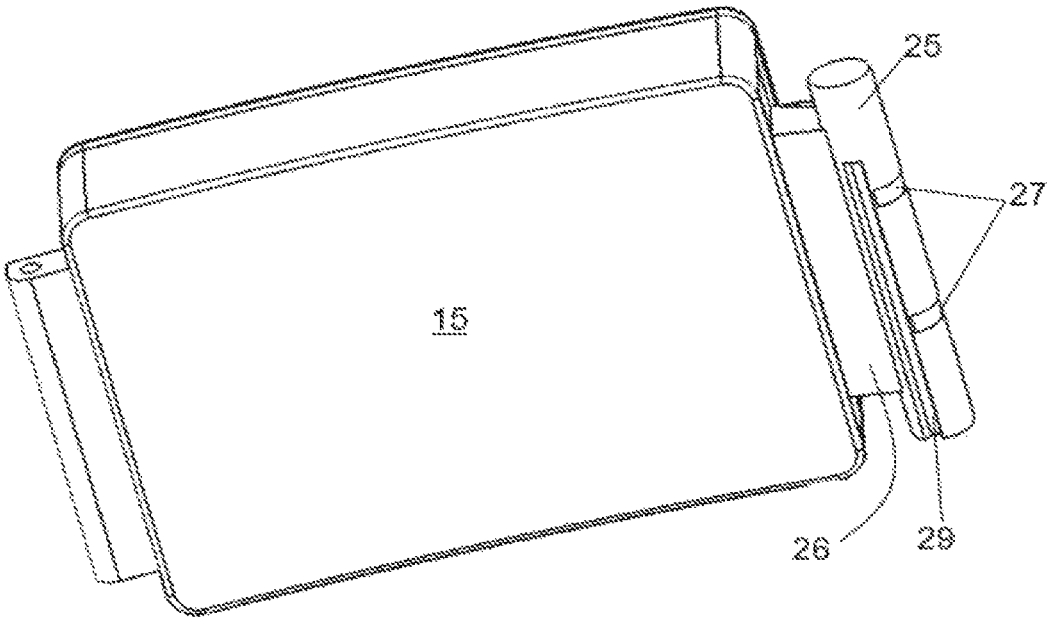
FIGS. 4*a* and 4*b* show two different 3D views of the battery housing used in the embodiment of FIGS. 3*a* and 3*b*, in order to illustrate one part of a rotatable and power transmitting coupling according to an embodiment of the invention.
Figure 4B:
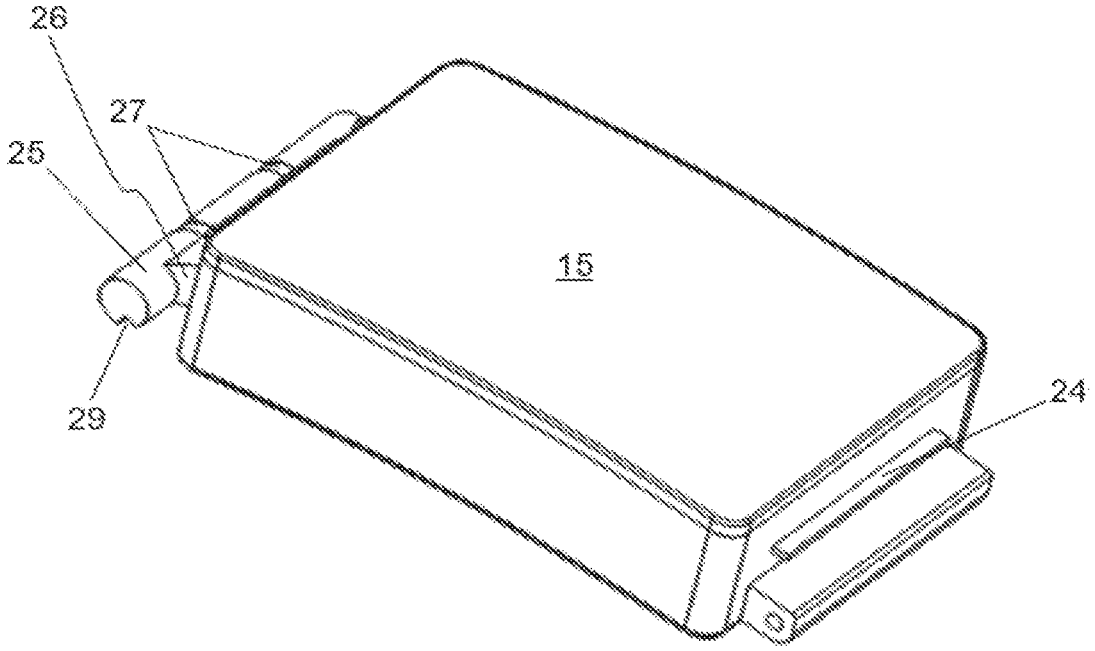

FIGS. 4*a* and 4*b* show separate 3D views taken from different angles, of the battery housing 15 used in the embodiment of FIGS. 3*a* and 3*b*, illustrating one part of the rotatable coupling 16 between the housing 15 and the power transmission strap part 7. A rod 25 with a circular cross-section is attached to one short side of the housing 15. The rod is immovably attached to the housing via a throat section 26. The rod 25 and the throat section 26 may be uniform with the housing 15. The rod 25 comprises two rounded contacts 27, the curvature of the contacts being essentially the same as the curvature of the rod's outer surface. The contacts 27 are spaced apart and may be placed symmetrically with respect to the mid-section of the rod 25. Inside the rod 25 and the throat section 26, conductive paths are present, which connect the contacts 27 directly to the poles of the battery or first to the circuits in the battery case and then to the poles of the battery.

At the underside of the rod 25, a groove 29 extends from one end of the rod, passing both contacts 27, i.e. up to a point beyond the two contacts 27. Alternatively, the groove 29 may extend along the entire length of the rod 25. Along the circumference of the rod 25, the rounded contacts 27 extend from the groove 29 to the upper side of the throat section 26. The rod 25 and the throat section 26 may be formed of metal which may be the same metal as the battery housing material when the throat section and the rod are uniform with the housing 15. The rounded contacts 27 may be gold-plated metal portions or bent flexible circuit board portions. The rounded contacts 27 could also be formed of electrically conductive plastic materials.

Figure 4C:
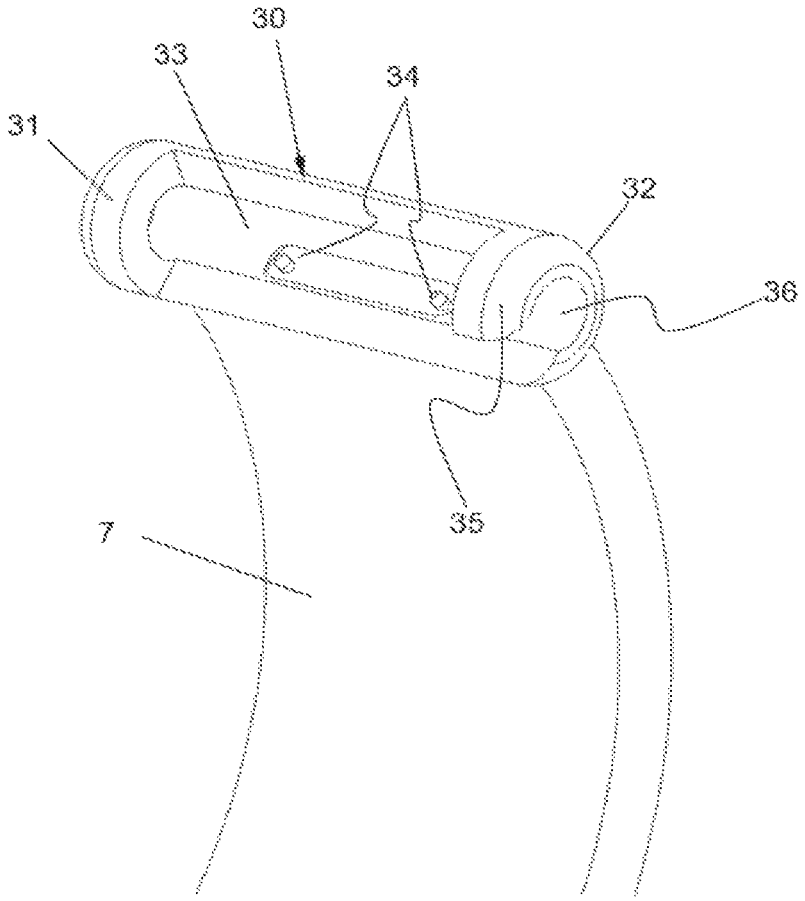
FIG. 4*c* illustrates the second part of the rotatable coupling illustrated in FIGS. 4*a* and 4*b*.

FIG. 4*c* illustrates the second part of the rotatable coupling 16, arranged at the distal end of the power transmission strap part 7. This second part comprises a hollow cylindrical bracket 30 attached to the distal end of the strap part 7. The bracket 30 comprises one closed end 31 and one open end 32, and a cutaway portion 33 in the bracket's sidewall. The cutaway portion 33 exposes at least part of the distal end of the power transmission strap part 7, into which distal end two spring-operated electrical contacts 34 are integrated, connected to electrical conductors (not-shown) integrated in the strap part 7. In the longitudinal direction of the cylindrical bracket 30, the cutaway portion 33 extends between the bracket's closed end 31, and a blocking lobe 35 on the opposite side of the bracket. The blocking lobe 35 is rounded so as to define a round entry passage 36 for the axial insertion or removal of the rod 25 into or from the interior of the bracket 30. The gap between the distal end of the blocking lobe 35 and the sidewall of the bracket 30 allows the passage of the throat section 26.

Figure 5A:
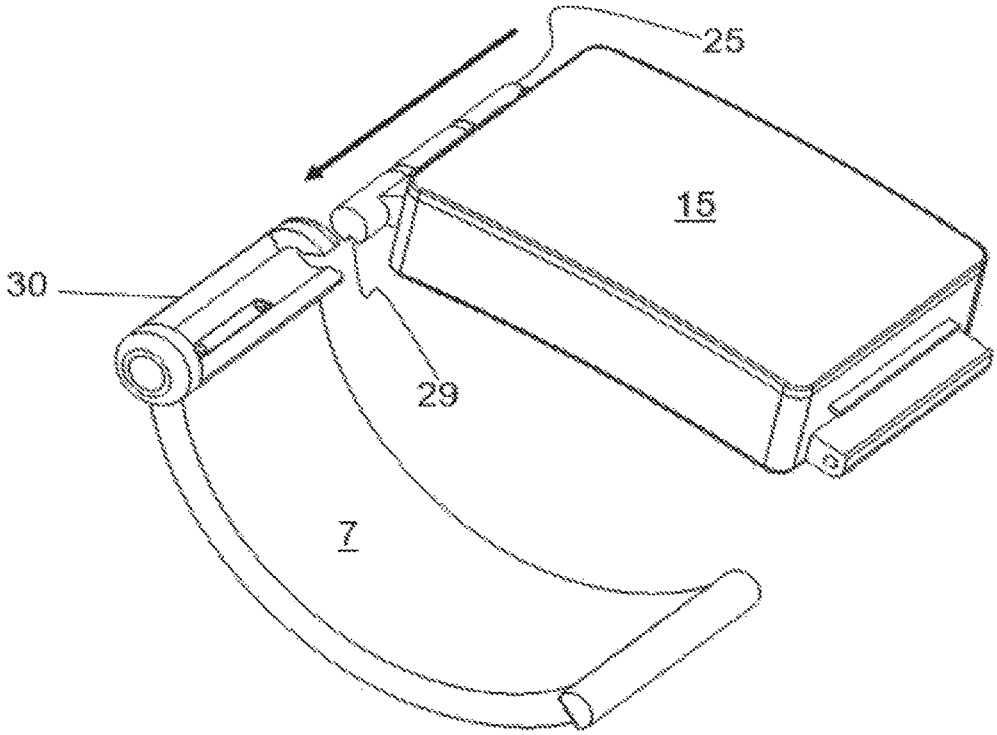
FIGS. 5*a* and 5*b* illustrate the assembly and securing of the rotatable coupling shown in FIGS. 4*a* to 4*c*.

The insertion of the rod 25 into the bracket is illustrated in FIG. 5*a*. The throat section 26 and the blocking lobe 35 are positioned so that the insertion is only possible—by the passage of the throat section 26 through the gap between the end of the blocking lobe 35 and the sidewall of the bracket 30—when the watch is not worn around the wearer's wrist, and at one angle or within a very limited range of the angle between the power transmission strap part 7 and the housing 15. As shown in FIG. 5*a*, at this angle or within this angular range, the strap part 7 is folded essentially fully towards the battery housing 15. The groove 29 is positioned so that at this angular position, the groove is aligned with the spring-operated contacts 34. The width and depth of the groove 29 are configured so that the spring-operated contacts 34 are not contacting any conductive material at the angular position that is required for the insertion or removal of the rod 25. In this way, a short circuit during insertion or removal of the rod 25 is prevented. The groove 29 could be filled with an electrically isolating material, or it could be replaced by a strip of isolation material. Once the rod 25 is fully inserted in the bracket 30, and the throat section 26 has passed the blocking lobe 35, the strap part 7 may be folded back, thereby establishing the electrical contact between the spring-operated contacts 34 and the rounded contacts 27, at any of the angular positions occurring when the watch is worn by the user. The blocking lobe 35 obstructs the release of the coupling at these angular positions, by preventing axial movement of the throat section 26, so that the rod 25 remains safely lodged within the bracket 30.

The disengagement of the coupling can be done by the wearer, after taking off the watch. The power transmission strap part 7 is folded again towards the battery housing 15 until the throat section 26 is aligned with the gap, after which the rod 25 can slide out of the bracket, while the groove 29 again prevents a short-circuit. Preferably, the same rotatable coupling is mounted between the watch case 8 and the power transmission strap part 7 and similar couplings, but without the contacts, are used between the other strap part 6 and on the one hand the watch case 8 and on the other hand the clasp. This allows the easy replacement of both the strap parts 6 and 7.

Figure 6A:
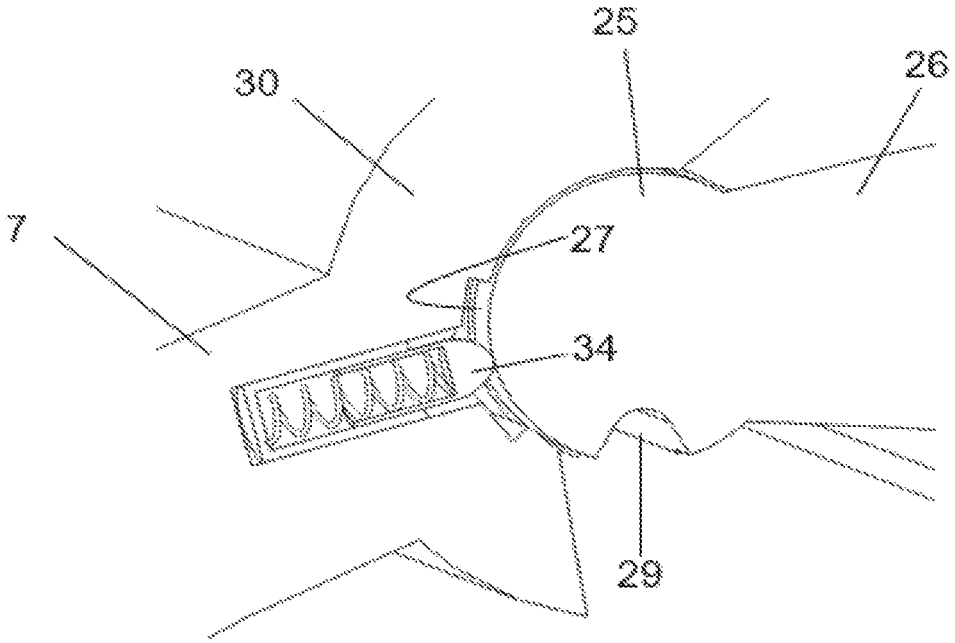
FIGS. 6*a* and 6*b* illustrate two possible embodiments of spring-operated contacts used in the rotatable coupling shown in FIGS. 4 and 5.
Figure 6B:
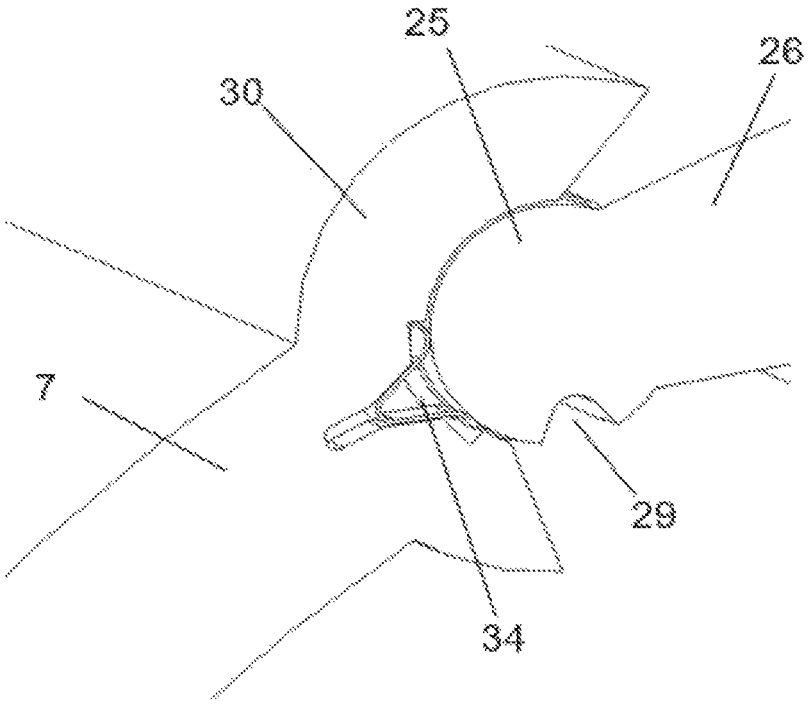

The spring-operated contacts 34 are embedded in the distal end of the power transmission strap part 7, and ensure that a conductive path is created between the rounded contacts 27 on the rod 25 and the wires integrated in the strap part 7. FIGS. 6*a* and 6*b* illustrate two possible ways of bringing the spring-operated contacts 34 into practice. FIG. 6*a* shows an embodiment with a helicoidal spring. FIG. 6*b* shows an embodiment with a V-shaped flat spring. Neither of these drawings shows the wires integrated in the strap part 7, nor the conductive paths within the rod 25 and the throat section 26.

Figure 5B:
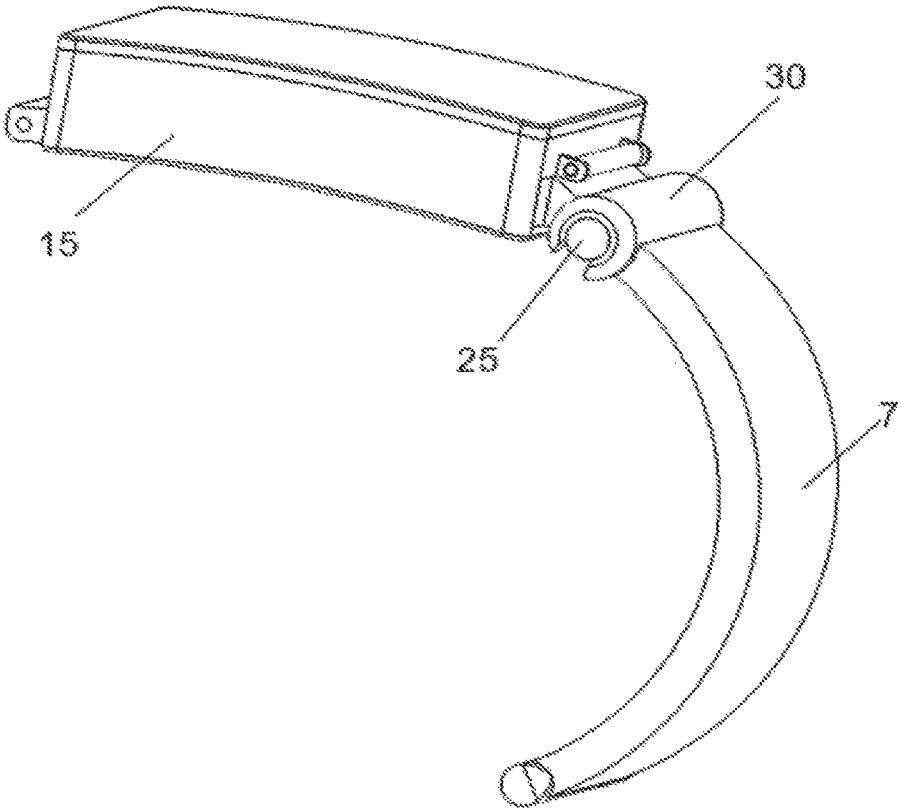

The rotatable coupling illustrated in FIGS. 4 and 5 may be provided with a sealing material to make the coupling waterproof. The sealing material may for example be placed inside the bracket 30 (as shown) or on the rod 25, so that it becomes pressed between the rod 25 and the bracket 30 when the rod is fully inserted into the bracket.

Figure 7A:
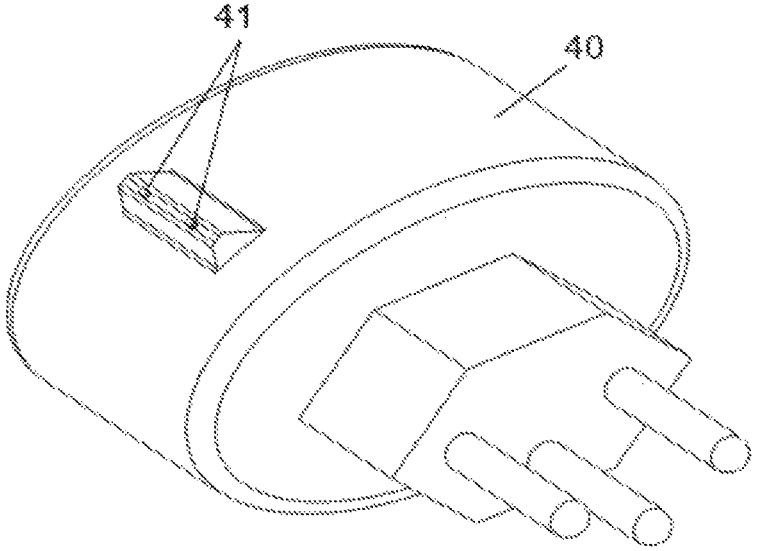
FIG. 7*a* illustrates a suitable charging device for charging the watch shown in FIGS. 3*a* and 3*b*.
Figure 7B:
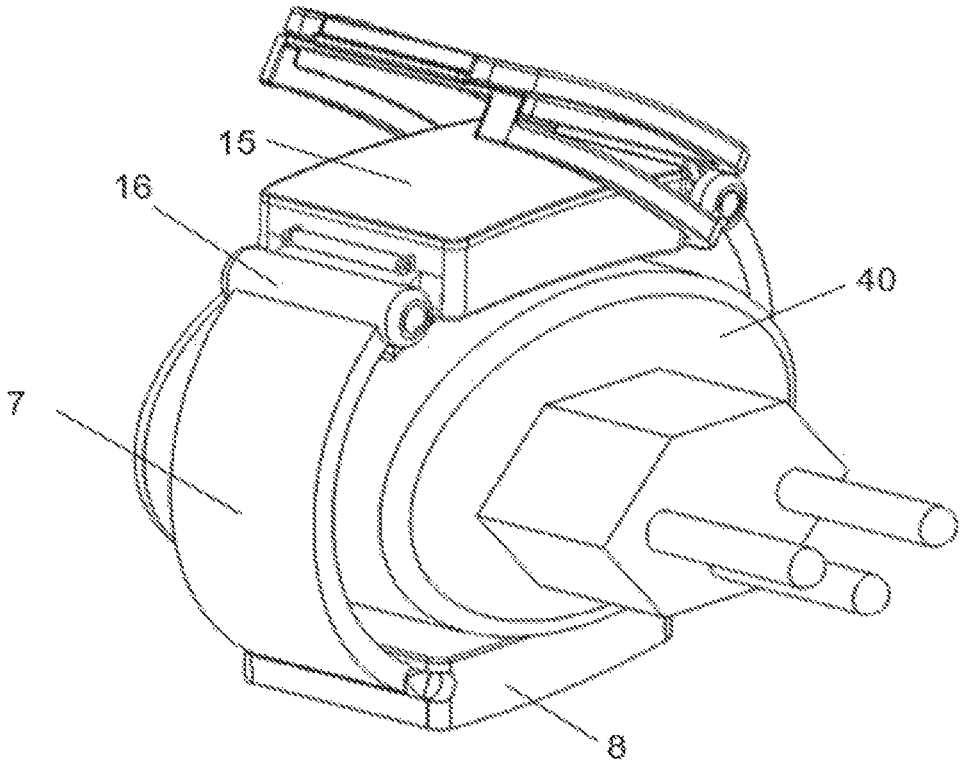
FIG. 7*b* illustrates how the watch is mounted on the charging device.

The rotatable coupling shown in FIGS. 4 and 5 is compact compared to existing solutions involving standard plug-in connectors for connecting the battery to the watch case and to a charger. The watch shown in FIGS. 3*a* and 3*b* can be charged by directly contacting the rounded contacts 27. A suitable charging device is illustrated in FIG. 7*a*. It comprises a rounded cylindrical body 40 dimensioned approximately as an average human wrist, and two charging contacts 41 spaced apart at the same distance as the rounded contacts 27 on the rod 25 coupled to battery housing 15. The watch may be placed onto the charging device as shown in FIG. 7*b*. The rounded contacts 27 are placed onto the charging contacts 41, for charging the battery.

The rotatable coupling of FIGS. 3 to 5 may be reversed, i.e. the rod 25 and the throat section 26 could be mounted on the distal end the power-transmission strap part 7, while the bracket 30 and the spring-operated contacts 34 are mounted on the battery housing 15.

The battery housing in any embodiment according to the invention comprises at least the battery as such, and may further comprise one or more of the following components: a charging circuit, a battery management circuit, a voltage converter, a display for indicating the charge state of the battery (e.g. LED or a light bar). The charge state of the battery is preferably also communicated to the watch case, and indicated thereon. This may be done by transmitting a status signal over separate wires embedded in the power transmission strap part, i.e. wires separate from the power transmission wires. Alternatively, the charge status could be transmitted by overlaying frequency signals over the power transmission wires.

In any of the above-described embodiments, the strap parts 6 and 7 may be formed of any material known in the art for this purpose, such as leather, plastic or metal providing that the respective power transmission wires having different polarity are insulated from each other. The power-transmission strap part 7 may for example be formed of plastic wherein the power transmission wires are encapsulated by the plastic material by plastic injection molding. Alternatively, the wires could be sewn into a leather strap part.

While the invention has been illustrated and described in detail in the drawings and foregoing description, such illustration and description are to be considered illustrative or exemplary and not restrictive. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A battery-operated wristwatch comprising:

a watch case, a first strap part and a second strap part coupled to opposite sides of the watch case, and a clasp for closing the strap parts around a wearer's wrist, wherein the watch comprises a battery housing containing a battery for powering the watch case, and wherein:

the battery housing is integrated in the clasp, one of the strap parts comprises power transmission wires, the battery housing is coupled to the one of the strap parts comprising the power transmission wires, by a first power transmitting coupling that allows the transmission of power to the watch case, through the one of the strap parts comprising the power transmission wires, the one of the strap parts comprising the power transmission wires is coupled to the watch case by a second power transmitting coupling, and wherein the first power transmitting coupling is a rotatable coupling comprising:

a cylindrical rod having a circular cross-section, wherein a portion of a sidewall of the rod is immovably attached to a throat section, and wherein the rod further comprises rounded contacts spaced apart in the longitudinal direction of the rod and an isolating strip or groove adjacent to the throat section and extending at least from one end of the rod to a location beyond both of the rounded contacts, a pair of spring-operated contacts spaced apart at a same distance as the pair of rounded contacts, a hollow cylindrical bracket comprising a closed end and an open end, and a cutaway portion of the sidewall of the bracket extending between the closed and open end, said cutaway portion being configured to expose the pair of spring-operated contacts, and wherein:

the open end comprises a blocking lobe configured to define a circular entry passage interrupted by a gap, the entry passage being dimensioned to allow the axial insertion of the rod into the bracket, while the gap allows the insertion of the throat section, the throat section is positioned so that the insertion or removal of the rod into or from the bracket is only possible at angular positions of the rod at which the isolating strip or groove is aligned with the spring-operated contacts, while at other angular positions, the rounded contacts are in contact with the spring-operated contacts when the rod is fully inserted into the bracket, and the angular positions at which the strip or groove is aligned with the spring-operated contacts are not accessible when the wristwatch is worn around the wrist of a user.

2. The wristwatch according to claim 1, wherein the clasp is a deployable clasp mounted between the distal ends of the strap parts, the clasp comprising a first and second curved clasp portion which are pivotable relative to each other so that they can be folded together, the clasp further comprising a mechanism for securing the clasp around the wearer's wrist when the clasp portions are fully folded, and wherein:

the battery housing is attached to the first or second clasp portion, the first power transmitting coupling between the battery housing and the one of the strap parts comprising the power transmission wires is the rotatable coupling.

3. The wristwatch according to claim 2, wherein the clasp portions are frame elements dimensioned and configured to be positioned around the battery housing when the frame elements are folded together.

4. The wristwatch according to claim 3, wherein the frame elements are respectively positioned around a lower and an upper portion of the battery housing when the clap is in the closed condition.

5. The wristwatch according to claim 2, wherein the battery housing is curved, having the same curvature as the clasp portion to which it is attached.

6. The wristwatch according to claim 1, wherein the rotatable coupling further comprises a seal.

7. The wristwatch according to claim 1, wherein the throat section is immovably attached to the battery housing, and wherein the bracket is immovably attached to the distal end of the one of the strap parts comprising the power transmission wires and wherein the spring-operated contacts are embedded in said distal end of the one of the strap parts comprising the power transmission wires.

8. The wristwatch according to claim 1, wherein another rotatable coupling is mounted between the one of the strap parts comprising the power transmission wires and the watch case.

9. The wristwatch according to claim 1, wherein the battery housing is shaped as a rectangular box.

10. The wristwatch according to claim 1, wherein the battery housing comprises one or more of the following components: a converter circuit, a battery management circuit, a charging circuit, a charge indicator.

11. The wristwatch according to claim 1, wherein the wristwatch is a smartwatch.

12. The wristwatch according to claim 1, wherein the battery housing and the frame elements are rectangularly shaped.

13. The wristwatch according to claim 1, wherein the battery housing is shaped as a curved rectangular box.

14. The wristwatch according to claim 1, wherein the one of the strap parts comprising the power transmission wires is the second strap part.

* * * * *